US009465312B2

(12) United States Patent
Iida et al.

(10) Patent No.: US 9,465,312 B2
(45) Date of Patent: Oct. 11, 2016

(54) IMAGE FORMING APPARATUS AND METHOD FOR ADJUSTMENT OF LIGHT AMOUNT DURING WEAK LIGHT EMISSION

(71) Applicant: CANON KABUSHIKI KAISHA, Tokyo (JP)

(72) Inventors: Masamichi Iida, Yokohama (JP); Hideaki Hirasawa, Mishima (JP); Kiyoto Toyoizumi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/912,062

(22) Filed: Jun. 6, 2013

(65) Prior Publication Data

US 2013/0328993 A1 Dec. 12, 2013

(30) Foreign Application Priority Data

Jun. 8, 2012 (JP) ..... 2012-131292

(51) Int. Cl.
*G03G 15/02* (2006.01)
*G03G 15/047* (2006.01)

(52) U.S. Cl.
CPC ..... *G03G 15/0275* (2013.01); *G03G 15/047* (2013.01); *G03G 2215/0132* (2013.01)

(58) Field of Classification Search
CPC ..... G03G 15/0275; G03G 15/80; G03G 15/043; G03G 15/04036
USPC ..... 347/236, 237, 246, 247
See application file for complete search history.

(56) References Cited

U.S. PATENT DOCUMENTS

| | | | | |
|---|---|---|---|---|
| 6,259,466 | B1 * | 7/2001 | Oomura | G06K 15/1214 347/237 |
| 6,795,099 | B2 * | 9/2004 | Koga et al. | 347/129 |
| 6,885,685 | B2 * | 4/2005 | Hidaka et al. | 372/38.02 |
| 6,917,639 | B2 * | 7/2005 | Ishida et al. | 372/38.02 |
| 7,642,729 | B2 * | 1/2010 | Saitoh et al. | 315/291 |
| 8,502,851 | B2 * | 8/2013 | Koga | 347/236 |
| 2008/0002747 | A1 * | 1/2008 | Ono | 372/38.02 |
| 2011/0025811 | A1 * | 2/2011 | Lee | B41J 2/471 347/224 |
| 2011/0221847 | A1 * | 9/2011 | Takezawa | G03G 15/5037 347/118 |
| 2012/0147119 | A1 * | 6/2012 | Toyoizumi | G03G 15/04072 347/224 |

FOREIGN PATENT DOCUMENTS

| | | | |
|---|---|---|---|
| JP | 8-171260 | A | 7/1996 |
| JP | 10-44504 | A | 2/1998 |
| JP | 2000-330346 | A | 11/2000 |
| JP | 2003-312050 | A | 11/2003 |
| JP | 2005-234032 | A | 9/2005 |
| JP | 2006-39026 | A | 2/2006 |

(Continued)

*Primary Examiner* — Matthew Luu
*Assistant Examiner* — Patrick King
(74) *Attorney, Agent, or Firm* — Canon U.S.A. Inc., IP Division

(57) ABSTRACT

A driving unit causes first and second light emitting units each to emit light in a time following a pulse duty with a light amount at a first light emission level for printing on an image portion in an image formable region of a photosensitive member according to input of print data, and causes the first and the second light emitting units each to emit light with a light amount at a second light emission level of weak light emission on a non-image portion in the image formable region of the photosensitive member, and an adjustment unit adjusts each of first, second, third, and fourth driving currents for a plurality of times in one job.

7 Claims, 11 Drawing Sheets

(56) References Cited

FOREIGN PATENT DOCUMENTS

| | | | | |
|---|---|---|---|---|
| JP | 2007-192967 | A | | 8/2007 |
| JP | 2007192967 | A | * | 8/2007 |
| JP | 2009-90524 | A | | 4/2009 |
| JP | 2009-294541 | A | | 12/2009 |
| JP | 2010-214892 | A | | 9/2010 |
| JP | 2012-137743 | A | | 7/2012 |

* cited by examiner

IMAGE FORMING APPARATUS AND METHOD FOR ADJUSTMENT OF LIGHT AMOUNT DURING WEAK LIGHT EMISSION

BACKGROUND OF THE INVENTION

1. Field of the Invention

The present invention relates to an image forming apparatus that employs an electrophotographic recording process such as a laser printer, a copying machine, and a facsimile.

2. Description of the Related Art

Conventionally, a phenomenon which is called a white gap has been known in color image forming apparatuses, in which a white gap which should not be originally present appears between images formed adjacent to each other in different colors. The phenomenon occurs resulting from the fact that an electrostatic latent image in which drum surface potential steeply changes, for example, an image edge portion, is formed on a photosensitive drum, and when this region is developed by a development device, a visualized image is formed thinner than original. For example, in an image in which a cyan color band and a black color band are formed adjacent to each other, essentially the cyan color band and the black color band ought to be adjacent to each other, but respective visualized images are formed thin, and a gap is produced between cyan color and black color in a final image on a recording material.

FIG. 11 illustrates the detail of a white gap related to the conventional technique and a state of an electric field between a development roller and a photosensitive drum. Thinning of a visualized image of visualized image portion which is a cause of the white gap is attributed to winding up of an electric field at an edge portion of an electrostatic latent image of an electrostatic portion formed on the photosensitive drum.

With respect to this issue, there is known a method for preventing an image from thinning by causing a light emitting element of a laser scanner to emit weak light to an extent not to attach the toner to a non-image portion (non-toner image forming portion) in the whole surface of printable region. Hereinbelow, the method is referred to as background exposure, or non-image portion weak light emission.

The purpose to perform non-image portion weak light emission is not limited to prevention of the white gap. As discussed in Japanese Patent Application Laid-Open No. 2003-312050, the non-image portion weak light emission is also executed as measures to decrease a transfer potential contrast and to prevent an image distortion associated with an aerial discharge which is generated at transfer a nip portion. In other words, the non-image portion weak light emission is not limited to specific purpose.

As a concrete approach for the non-image portion weak light emission, for example, a method called a pulse width modulation (PWM) process for changing a duty ratio of a pulse wave is discussed in Japanese Patent Application Laid-Open No. 2003-312050. The method is to cause a light emitting element of a laser scanner to emit light in a non-image portion at a pulse width equivalent to a weak light emission amount in synchronization with an image clock with a fixed frequency.

In recent years, further higher image quality has been requested for color image forming apparatuses. Under such situation, in addition to an adjustment of a light emission amount corresponding to an image portion, appropriate adjustment of a light amount in the weak light emission of the non-image portion described above is an important issue.

SUMMARY OF THE INVENTION

The present invention is directed to an appropriate adjustment of a light amount in weak light emission of a non-image portion, in addition to an adjustment of a light emission amount corresponding to an image portion an image forming apparatus.

According to an aspect of the present invention, an image forming apparatus includes a photosensitive member, a charging unit configured to charge the photosensitive member, a first light emitting unit and a second light emitting unit each configured to independently enable of performing light emission of a laser beam, wherein a latent image is formed on the charged photosensitive member by light emission of the first and the second light emitting units, and an image is formed on a recording material by attaching toner to the latent image to visualize it, a driving unit configured to cause the first and the second light emitting units to emit light by a driving current, wherein the driving unit causes the first and the second light emitting units each to emit light in a time following a pulse duty with a light amount at a first light emission level for printing on an image portion in an image formable region of the photosensitive member according to input of print data, and causes the first and the second light emitting units each to emit light with a light amount at a second light emission level of weak light emission on a non-image portion in the image formable region of the photosensitive member, and wherein the driving unit causes the first light emitting unit to emit light at the first light emission level by a driving current obtained by adding a second driving current to a first driving current, causes the first light emitting unit to emit light at the second light emission level by the second driving current, causes the second light emitting unit to emit light at the first light emission level by a driving current obtained by adding a fourth driving current to a third driving current, and causes the second light emitting unit to emit light at the second light emission level by the fourth driving current, and an adjustment unit configured to adjust each of the first, the second, the third, and the fourth driving currents a plurality of times in one job.

Further features of the present invention will become apparent from the following description of exemplary embodiments (with reference to the attached drawings).

DESCRIPTION OF THE EMBODIMENTS

Various exemplary embodiments, features, and aspects of the invention will be described in detail below with reference to the drawings. It is to be noted that the components set forth in these embodiments are merely examples and are not intended to limit the scope of the present invention.

<Schematic Cross-Sectional View of Image Forming Apparatus>

Figure 1:
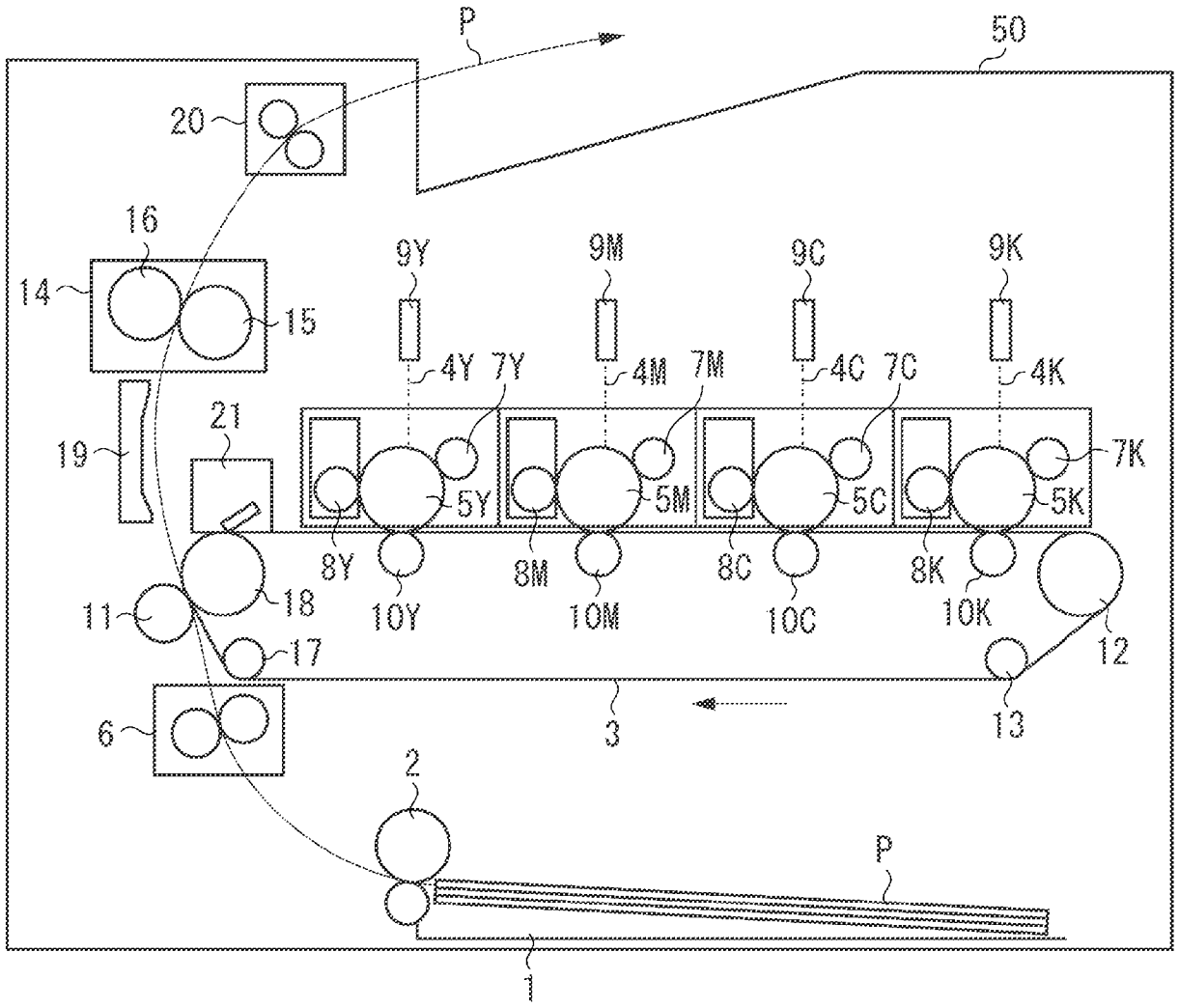
FIG. 1 illustrates an example of schematic cross-sectional view of an image forming apparatus.

FIG. 1 is a schematic cross-sectional view of a color image forming apparatus. The descriptions below are be provided with reference to the color image forming apparatus, but the present exemplary embodiment is not limited to the color image forming apparatus. The weak light emission of the non-image portion as will be described below in detail can be also applied to, for example, a single color image forming apparatus. In addition, descriptions will be provided taking an in-line type color image forming apparatus as an example, however, for example, a rotary type color image forming apparatus may be used. Hereinbelow, an in-line type color image forming apparatus will be described in detail by way of example.

As illustrated in FIG. 1, a color laser printer 50 includes photosensitive drums 5 (5Y, 5M, 5C, and 5K) serving as a plurality of first image bearing members. The color laser printer 50 continuously performs multiple transfer of images formed on the photosensitive drums onto an intermediate transfer belt 3 serving as a second image bearing member in a sequential manner to obtain a full-color print image. The method is referred to as an in-line type or four serially arranged tandem drum type.

The intermediate transfer belt 3 is an endless-shaped belt, i.e., an endless belt, suspended around a driving roller 12, a tension roller 13, an idler roller 17, and a secondary transfer counter roller 18, and is rotated at a process speed of 115 mm/sec in a direction of an arrow in FIG. 1. The driving roller 12, the tension roller 13, and the secondary transfer counter roller 18 are supporting rollers that support the intermediate transfer belt 3. The driving roller 12 and the secondary transfer counter roller 18 have a diameter of ϕ24, and the tension roller 13 has a diameter of ϕ16.

Four photosensitive drums 5 (5Y, 5M, 5C, and 5K) are arranged in series in a movement direction of the intermediate transfer belt 3. Image exposure units 9 (9Y, 9M, 9C, and 9K) are arranged in correspondence with the respective photosensitive drums 5. The photosensitive drum 5Y including a yellow development device is uniformly charged to a predetermined polarity/potential by a primary charging roller 7Y in a rotation process, and then subjected to image exposure 4Y by being irradiated with light by the image exposure unit 9Y. Accordingly, an electrostatic latent image corresponding to a first color (yellow) component image of the target color image is formed. Then, a first development device (yellow development device) 8Y applies yellow toner as a first color to the electrostatic latent image, so that the latent image is developed. Accordingly, visualization of the image is performed. As described above, a process in which toner is developed at a portion where the electrostatic latent image has been formed by the image exposure is referred to as a "reversal developing method".

The yellow image formed on the photosensitive drum 5Y enters into a primary transfer nip portion of the intermediate transfer belt 3. At the primary transfer nip portion, a voltage applying member (primary transfer roller) 10Y is brought into contact with and abut against a back side of the intermediate transfer belt 3. A primary transfer bias power source (not illustrated) is connected to the voltage applying member 10Y for enabling bias application. Firstly, the yellow image is transferred at a first color port, and then respective color images of magenta, cyan, and black are sequentially transferred by overlaying onto one after another onto the intermediate transfer belt 3, from the photosensitive drums 5M, 5C, and 5K corresponding to the respective colors after going through the processes described above. The toner images of four colors transferred onto the intermediate transfer belt 3 is rotated and moved in the direction of the arrow (clockwise direction) in FIG. 1, accompanying the intermediate transfer belt 3.

On the other hand, a recording material P stored in a paper feeding cassette 1 is fed by a paper roller 2, is conveyed to a nip portion of a registration roller pair 6, and is temporarily stopped. The temporarily stopped recording material P is supplied to the secondary transfer nip by the registration roller pair 6, in synchronization with a timing at which the toner images of four colors formed on the intermediate transfer belt 3 reach the secondary transfer nip. Then, the toner images on the intermediate transfer belt 3 are transferred onto the recording material P by voltage (about +1.5 kV) applied between a secondary transfer roller 11 and the secondary transfer counter roller 18.

The recording material P onto which the toner image has been transferred, is separated from the intermediate transfer belt 3, and is sent to a fixing device 14 via a conveyance guide 19. At the fixing device 14, the toner image is fused and fixed on the surface of the recording material P by being heated/pressed by a fixing roller 15 and a pressure roller 16. Accordingly, a full-color (a plurality of colors) image with four colors is obtained. Then, the recording material P is discharged to the outside of the image forming apparatus by a discharge roller pair 20, and thus, one cycle of printing ends. On the other hand, toner remained on the intermediate transfer belt 3 without being transferred onto the recording material P in the secondary transfer portion is removed by a cleaning unit 21 arranged on a downstream side of the secondary transfer portion.

Accordingly, the schematic cross-sectional view of the image forming apparatus is described. Next, in connection with the laser driving system, first, an outline view of an optical scanning device (which corresponds to the image exposure unit 9) will be described below, and then, a circuit configuration of a laser driving system will be described in detail.

<Schematic View of Optical Device>

Figure 2:
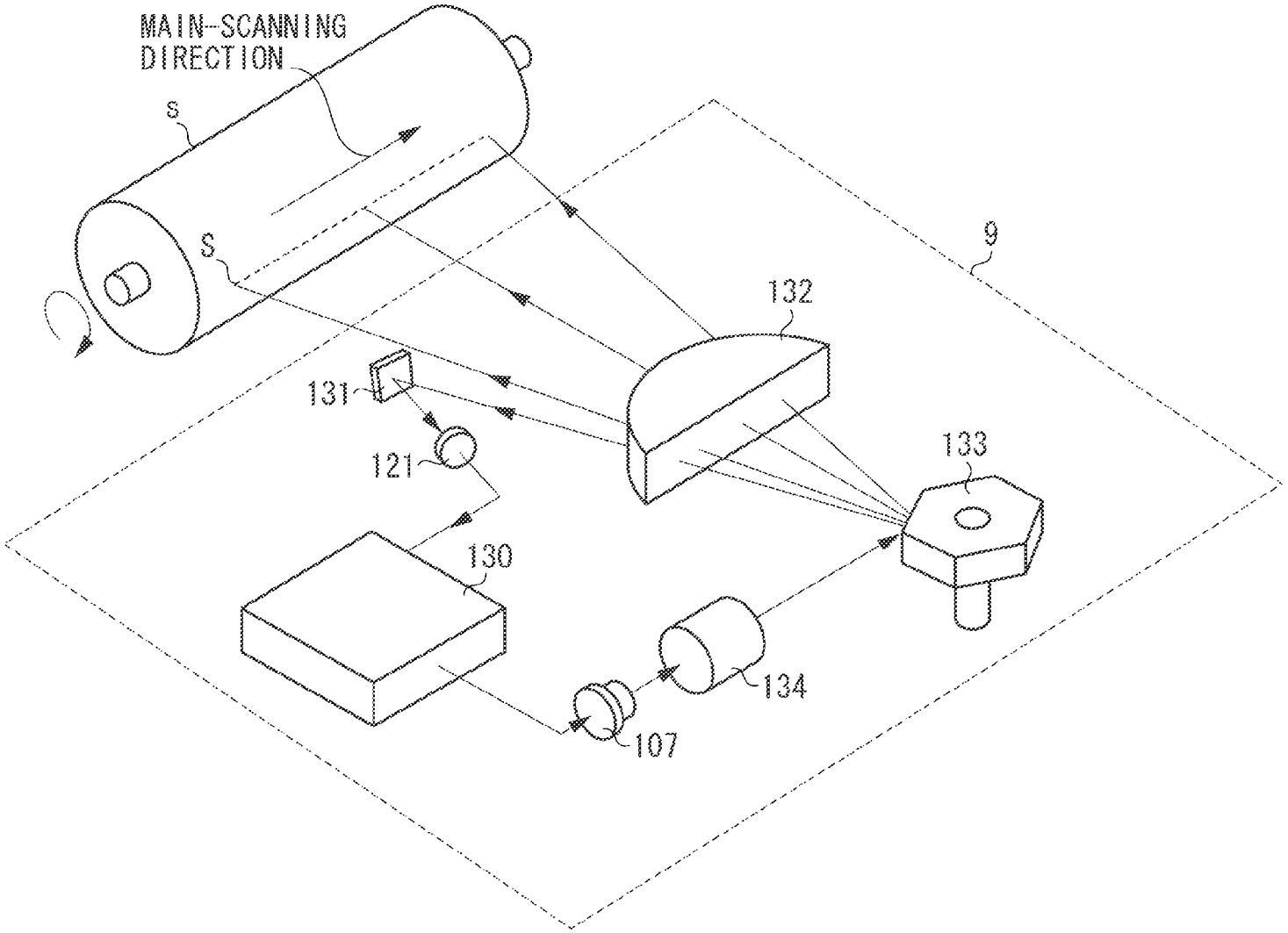
FIG. 2 is schematic perspective view of an optical scanning device.

FIG. 2 illustrates a schematic perspective view of an optical scanning device 9. A laser diode 107 (hereinbelow, referred to as LD 107) with two beams includes two light emitting elements (light emitting units) which can independently emit light. Two laser diodes are built in the LD 107, and each of them is referred to as an LD 107*a* (first light emitting unit), and an LD 107*b* (second light emitting unit). A driving current flows through the LD 107 based on an operation of a laser driving system circuit 130. The LD 107 emits a laser beam at an intensity level corresponding to the driving current. The laser driving system circuit 130 is a circuit for driving the LD 107 electrically connected thereto, with respect to an engine controller 122 and a video controller 123 which are described below.

Then, a beam shape of the laser beam emitted by the LD 107 is shaped and made into parallel beams by a collimator lens 134. Then, the laser beams are reflected by a rotating polygon mirror 133 to deflect and scan. The deflected and scanned laser beams transmitted through an f-theta lens 132 is formed as an image of a dot-like spot on the surface of the photosensitive drum 5 which is rotated around its shaft, and is formed as a scanning line by being moved in the main scanning direction (parallel in a direction of the rotating shaft of the photosensitive drum 5) indicated by an arrow in FIG. 2, so that the photosensitive drum 5 is exposed.

On the other hand, a reflection mirror 131 is provided at a position on which the laser beam is incident. The laser beam incident position is located on an upstream side of the main scanning direction than a scanning start position S of the scanning line on the photosensitive drum 5. The laser beam incident on the reflection mirror 131 is incident on a beam detection sensor (hereinbelow, described as BD sensor) 121. The BD sensor 121 detects that the laser beam is incident, and performs a corresponding output. A scanning start timing of the laser beams is determined based on the output from the BD sensor. After scanning the photosensitive drum 5 and before scanning the photosensitive drum 5 next time, auto power control (APC) which is automatic light amount control of a laser light amount is performed, and a light emission level (light emission intensity) of the laser diode 107 is adjusted for the next scanning.

During image formation, the optical scanning device 9 performs light emission (normal light emission) based on the image data at a printing light emission level (intensity) enough to attach toner to an image portion in an image formable region of the surface of the photosensitive drum 5 (i.e., an effective region of the photosensitive drum 5). Further, the optical scanning device 9 performs weak light emission on a non-image portion in the image formable region of the surface of the photosensitive drum 5 (the effective region of the photosensitive drum 5) at a weak light emission level (intensity) not to attach the toner thereto. Such a weak light emission is performed in order to ensure a proper electric potential of the non-image portion of the photosensitive drum 5 after being charged, so as not to cause image defects such as fogs or reverse fogs.

<Laser Driving System Circuit Diagram>

Figure 3:
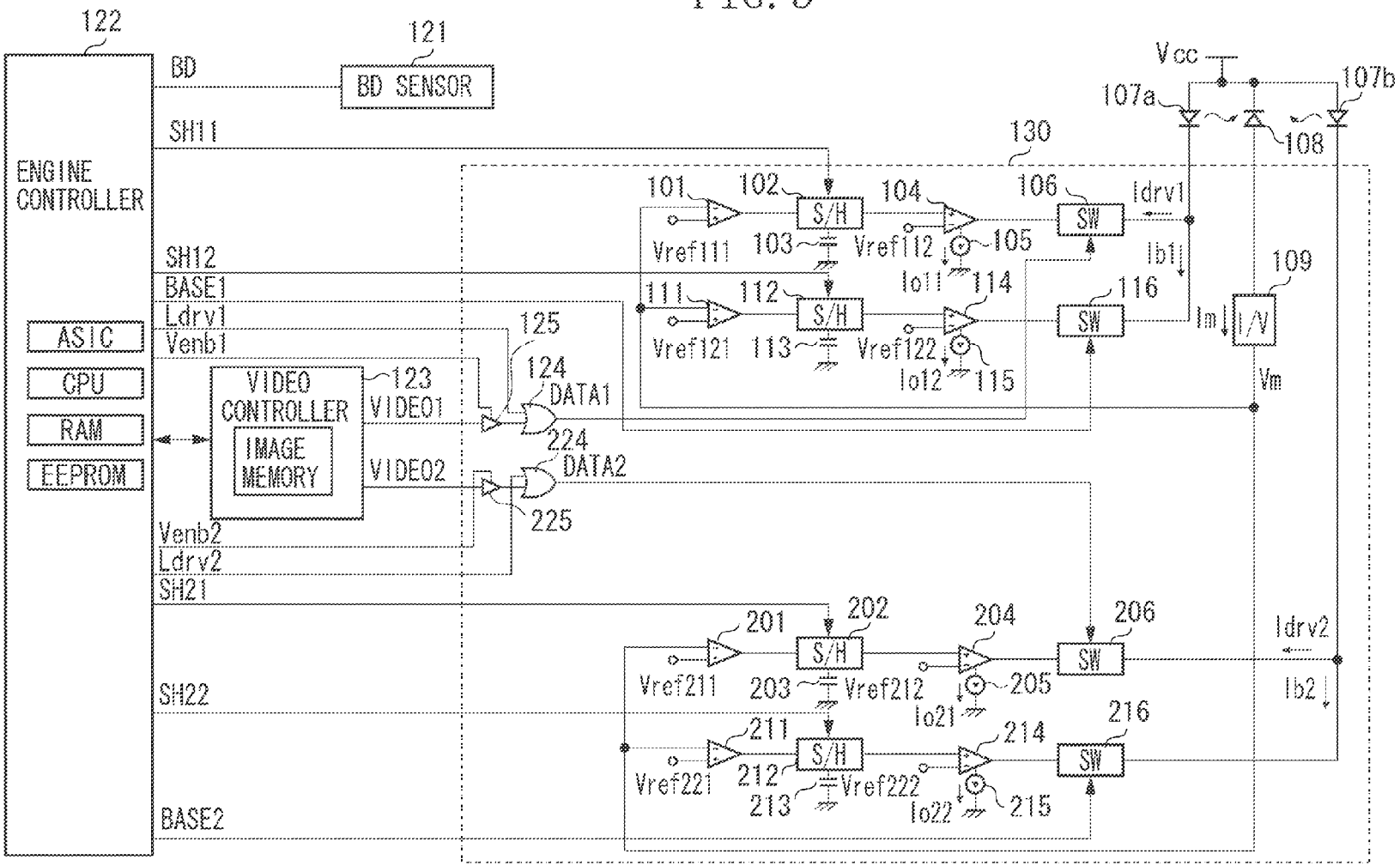
FIG. 3 is a circuit diagram of a laser driving circuit.

FIG. 3 illustrates a laser driving system circuit for automatically adjusting an appropriate light amount level of the LD 107 in performing weak light emission, so as to prevent adherence of the toner to the photosensitive drum, and to prevent occurrence of fogs or reverse fogs in the non-image portion.

So as not to complicate the descriptions, a configuration related to control of the LD 107*a* will be described below. As for a configuration related to control of the LD 107*b*, descriptions of the configuration similar to that of the LD 107*a* will not be repeated, and a configuration different from that of the LD 107*a* will be described.

In FIG. 3, the laser driving system circuit 130 illustrated in FIG. 2 corresponds to a circuit surrounded by a dotted line frame. The laser driving system circuit includes comparator circuits 101 and 111, sample and hold circuits 102 and 112, hold capacitors 103 and 113, current amplification circuits 104 and 114, reference current sources 105 and 115 (constant current circuits), and switching circuits 106 and 116. A photodiode 108 serves as a light receiving unit and receives laser beams emitted from the LD 107*a* and the LD 107*b*. A current/voltage conversion circuit 109 is also included in the laser driving system circuit 130. In addition, BD sensor (horizontal synchronization signal output unit) 121 is provided. Hereinbelow, the photodiode 108 is referred to as a PD 108. As described below in detail, with respect to the LD 107*a*, portions 101 to 106 correspond to a first light amount adjustment unit, and portions 111 to 116 correspond to a second light amount adjustment unit.

The engine controller 122 includes an application specific integrated circuit (ASIC), a central processing unit (CPU), a random access memory (RAM), and an electrically erasable and programmable read-only memory (EEPROM) therein. The engine controller 122 performs not only control of a printer engine, but also communication control with the video controller 123.

A Ldrv1 signal of the engine controller 122 and a VIDEO1 signal from the video controller 123 are connected to an input of an OR circuit 124, and an output signal DATA1 is connected to a switching circuit 106 described below. The VIDEO1 signal is generated based on print data transmitted from external devices such as a reader scanner or a host computer externally connected.

The VIDEO1 signal output from the video controller 123 is input into a buffer 125 with an enable terminal, and an output of the buffer 125 is connected to the OR circuit 124 described above. At that time, the enable terminal is connected to a Venb1 signal from the engine controller 122. Further, the engine controller 122 is connected to output an SH11 signal, an SH12 signal, a BASE1 signal, an Ldrv1 signal, and a Venb1 signal described below.

A first reference voltage Vref111 and a second reference voltage Vref121 are respectively input into positive terminals of the comparator circuits 101 and 111, and outputs thereof are respectively input into the sample and hold circuits 102 and 112. The reference voltage Vref111 is set as a target voltage for causing the LD 107*a* to emit light at a light emission level for normal printing (first light emission level). The reference voltage Vref121 is set as a target voltage of a light emission level for weak light emission (second light emission level). The hold capacitors 103 and 113 are connected to the sample and hold circuits 102 and 112, respectively. Outputs of the hold capacitors 103 and 113 are input into positive terminals of the current amplification circuits 104 and 114, respectively.

The reference current sources 105 and 115 are connected to the current amplification circuits 104 and 114, respectively, and their outputs are input into the switching circuits 106 and 116. On the other hand, a third reference voltage Vref112 and a fourth reference voltage Vref122 are input into negative terminals of the current amplification circuits 104 and 114, respectively. Electric currents Io11 and Io12 are determined according to output voltages of the sample and hold circuits 102 and 112 described above, and a difference between the reference voltage Vref112 and the reference voltage Vref122. In other words, the reference voltages Vref112 and Vref122 are voltage settings for determining electric currents.

The switching circuit 106 performs ON/OFF operations by a pulse modulation data signal DATA1. The switching circuit 116 performs ON/OFF operations by an input signal BASE1.

Output terminals of the switching circuits 106 and 116 are connected to a cathode of the LD 107*a*, and supply driving currents Idrv1 (first driving current), and Ib1 (second driving current). An anode of the LD 107*a* is connected to a power source Vcc. A cathode of the PD 108 for monitoring the light amount of the LD 107*a* is connected to the power source Vcc. An anode of the PD 108 is connected to the current/voltage conversion circuit 109 and generates a monitor voltage Vm by applying a monitor current Im to the current/voltage conversion circuit 109. The monitor voltage is input in a negative feedback into negative terminals of the comparators 101 and 111.

The configuration related to the control of the LD 107*a* is described above, and since the configuration related to the control of the LD 107*b* is similar thereto, descriptions thereof will not be repeated.

In FIG. 3, although the engine controller 122 and the video controller 123 are illustrated separately, it is not limited to this configuration. For example, a part or whole of the engine controller 122 and the video controller 123 may be formed by the same controller. In addition, a part or whole of the laser driving circuit 130 surrounded with the dotted line frame in FIG. 3 may be incorporated into, for example, the engine controller 122.

Descriptions of APC of P(Idrv)

The engine controller 122 sets the sample and hold circuit 112 to a hold state (during non-sampling period) by an instruction of the SH12 signal, and sets the switching circuit 116 to an OFF operation state by the input signal BASE1. Further, the engine controller 122 turns the SH11 signal ON, sets the sample and hold circuit 102 to the sampling state, and turns the switching circuit 106 ON by an input signal DATA1. In more detail, at that time, the engine controller 122 turns the Ldrv1 signal ON, and sets the input signal DATA1 so that the LD 107*a* becomes a light emitting state. A period during which the sample and hold circuit 102 is in the sampling state corresponds to a period during an auto power control (APC) operation.

In this state, when the LD 107*a* becomes a whole surface light emitting state, the PD 108 receives the laser beam emitted from the LD 107*a*, and generates a monitor current 1 ml proportional to the light receiving amount to monitor the light emission amount of the LD 107*a*. Then, by applying the monitor current 1 ml to the current/voltage conversion circuit 109, the monitor voltage Vm1 is generated. The current amplification circuit 104 controls the driving current Idrv1 (the first driving current) based on the current Io11 flowing through the reference current source 105 so that the monitor voltage Vm1 coincides with the first reference voltage Vref111 as a target value. The reference voltage Vref111 has a voltage value corresponding to a light emission level P(Idrv1). Such an APC operation at a strong light emission level in the LD 107*a* is referred to as APC_Pa.

During when the APC operation is not operated, namely, during the normal image formation, the SH11 signal is turned OFF, and the sample and hold circuit 102 enters a hold period (during non-sampling period). Further, the Ldrv1 signal is turned OFF, the switching circuit 106 performs the ON/OFF operation according to the input signal data DATA1, and pulse width modulation is applied to the driving current Idrv1.

With respect to the LD 107*b*, the engine controller 122 performs the APC by the control similar to the above-described one, and controls a driving current Idrv2 (third driving current). In other words, the engine controller 122 performs the APC operation of the LD 107*b* by controlling the SH21 signal and the Ldrv2 signal similar to the above-described control. The APC operation at a strong light emission level in the LD 107*b* is referred to as APC_Pb.

Descriptions of APC of P(Ib)

On the other hand, the engine controller 122 turns the SH11 signal OFF, sets the sample and hold circuit 102 to the hold state (during non-sampling period), and sets the switching circuit 106 to an OFF operation state by the input signal DATA1. Regarding the input signal DATA1, the engine controller 122 sets the Venb1 signal connected to an enable terminal of the buffer 125 with the enable terminal to a disable state, turns the Ldrv1 signal OFF, and sets the input signal DATA1 to an OFF state. Further, the engine controller 122 turns the SH12 signal ON, sets the sample and hold circuit 112 to during the APC operation, and turns the switching circuit 116 ON by turning ON the input signal BASE1 to set the LD 107*a* to enter the weak light emitting state.

In this state, when the LD 107*a* becomes a whole surface weak light emitting state (illumination maintaining state) in a weak light amount state, the PD 108 receives the laser beam emitted from the LD 107*a*, and generates a monitor current Im2 (Im1>Im2) proportional to the light receiving amount to monitor the light emission amount of the LD 107*a*. Then, a monitor voltage Vm2 is generated by applying the monitor current Im2 to the current/voltage conversion circuit 109. The current amplification circuit 114 controls a driving current Ib1 (a second driving current) based on the current Io12 flowing through the reference current source 115 so that the monitor voltage Vm2 coincides with the second reference voltage Vref121 as a target value. The reference voltage Vref121 has a voltage value corresponding to the light emission level P(Ib1). The APC operation at the weak light emission level in the LD 107*a* is referred to as APC_Ba.

During when the APC operation is not operated, namely, during the normal image formation (a period when an image signal is being transmitted), the sample and hold circuit 112 enters the hold period (during the non-sampling period), and the whole surface weak light emitting state in a weak light amount state is maintained.

With respect to the LD 107*b*, the APC is performed by control similar to the above-described control, and a driving current Ib2 (fourth driving current) is controlled. In other words, the engine controller 122 performs the APC operation of the LD 107*b* by controlling the SH22 signal and the BASE2 signal similar to the above-described control. The APC operation at the weak light emission level in the LD 107*b* is referred to as APC_Bb.

If fogs or reverse fogs of toners are ignored, it is only necessary to set a laser light emission amount in the weak light emission to appropriate intensity in such a degree that charging potential does not fall below developing potential, however, the laser light emission amount cannot be set to such a level. In other words, if fogs and reverse fogs of toners are taken into consideration, it is necessary to always maintain the light amount of the light emission level P(Ib) stable during the image formation.

Descriptions of Weak Light Emission Level

Figure 4:
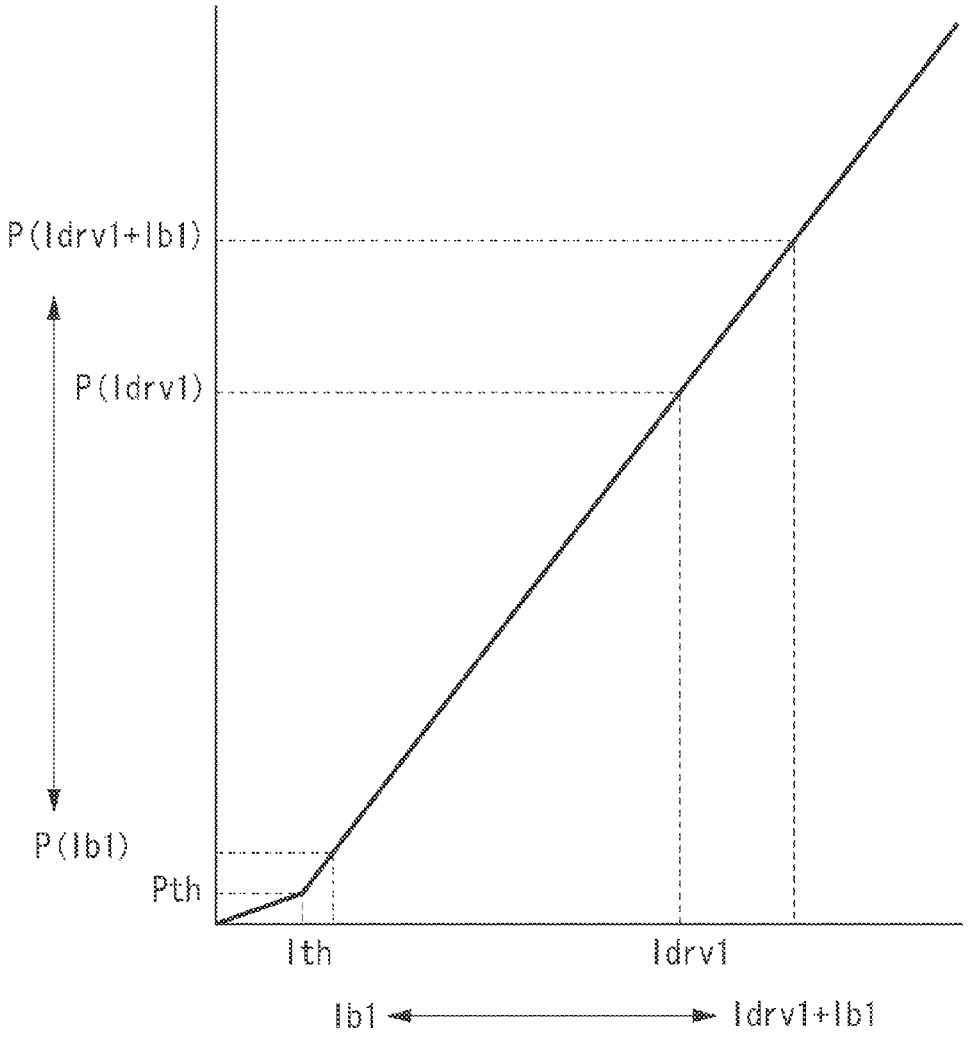
FIG. 4 illustrates a relationship between electric current flowing through a laser diode and light emission intensity.

In the above descriptions, a driving current Ib1 during the whole surface weak light emitting state is set to exceed a threshold value current Ith of the LD 107*a* illustrated in FIG. 4, and to become the weak light emission level P(Ib1). The weak light emission level means a light emission intensity level at which developer such as toner is not substantially charged and attached to the photosensitive drum (an image is not visualized) even by the laser irradiation of that level, and a light emission intensity level for improving a toner fogging state. Further, the light emission level P(Ib1) is a laser light emission level at which the LD 107*a* emits laser light. If the light emission level P(Ib1) at that time is an LED light emission level which is less than the laser light emission level, spectral wavelength distribution spreads, and becomes wider wavelength distribution relative to a rated wavelength of the laser beam. Consequently, sensitivity of the photosensitive drum is disturbed, and surface potential becomes unstable. Therefore, it is desirable that the light emission level P(Ib1) is the laser light emitting region which is equal to or greater than the LED light emitting region On the other hand, at the time of normal image formation, the driving current Idrv1 is set so that a driving current Idrv1+Ib1 becomes a light emission level at which a light emission intensity becomes a print level P(Idrv1+Ib1). The print level means a light emission intensity level at which charged adherence of the developer onto the photosensitive drum reaches a saturated state.

Figure 5:
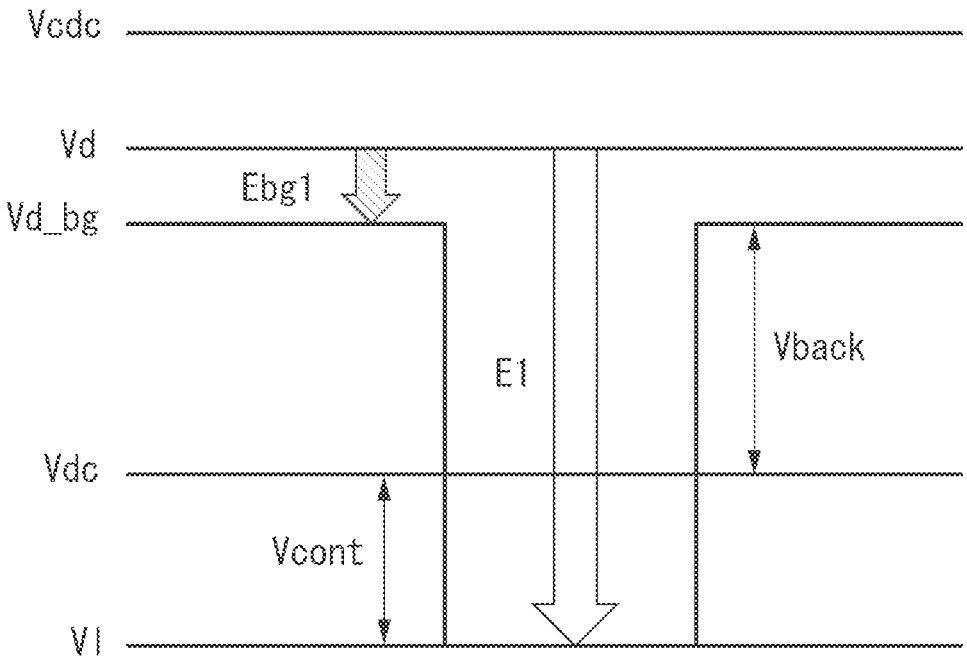
FIG. 5 illustrates an electric potential change of a photosensitive drum related to weak light emission.

The weak light emission level will be described in more detail with reference to FIG. 5. Charging voltage Vcdc applied to the photosensitive drum 5 from a charging high-voltage power source (not illustrated) via the primary charging roller 7 appears as a charging potential Vd on the surface of the photosensitive drum 5. At that time, the charging potential Vd is set to a potential higher than the charging potential of the non-image portion at the time of toner development.

Then, the charging potential Vd is attenuated to charging potential Vd_bg by the laser light emission at a weak light emission level Ebg1. After the charging voltage Vcdc has been applied, a potential higher than a convergence potential may be generated in spots on the photosensitive member surface in some cases, which will increase a back contrast Vback and induce reverse fogs. On this point, when the charging potential Vd is attenuated to the charging potential Vd_bg by the laser light emission at the above-described weak light emission level Ebg1, remaining of a potential higher than such convergence potential is reduced, and reverse fogs can be inhibited at least. In addition, it is also well known that a transfer memory appears in the charging potential Vd. On this point, the transfer memory can be decreased by the laser light emission at the above-described weak light emission level Ebg1, and occurrence of ghost images due to the transfer memory can be at least inhibited.

The laser light emission at the above-described weak light emission level Ebg1 bears the function of adjusting a back contrast Vback to a proper value which is a potential difference from a developing potential Vdc. From this viewpoint, occurrence of positive fogs or reverse fogs of toners can be inhibited. At the same time, a development contrast Vcont (=Vdc−Vl) which is a difference value between the developing potential Vdc and an exposing potential Vl can be also properly adjusted. Accordingly, reduction of development efficiency or occurrence of sweeping can be suppressed, and a margin of transfer/retransfer can be secured.

The above-described charging voltage Vcdc can be set to vary according to an environment or deterioration (usage status) of the photosensitive drum or the like. A light amount (intensity) at a targeted weak light emission level is also set to vary accordingly. For example, if a value of the charging voltage Vdcd becomes large, a light amount of the weak light emission level Ebg1 also becomes large. Whereas, if a value of the charging voltage Vdcd becomes small, a light amount at the weak light emission level Ebg1 also becomes small.

More specifically, it is desirable to set the charging potential Vd to −700 V to −600 V, the charging potential Vd_bg to −550 V to −400 V, the developing potential Vdc to −350 V, and the exposing potential Vl to −150V.

Descriptions of P(Ib1+Idrv1) Light Emission

When the LD 107*a* emits light at a light emission level for normal printing, the circuit in FIG. 3 is operated as follows. The sample and hold circuit 112 is set to the hold period, and the switching circuit 116 is put into an ON operation. In addition, the sample and hold circuit 102 is set to the hold period, and the switching circuit 106 is put into an ON operation. Accordingly, the driving current Idrv1+Ib1 is supplied. In addition, the weak light emission level light emission intensity P(Ib1) of the driving current Ib1 can be obtained in the OFF state of the switching circuit 106.

As will be described below in detail, the print level P(Idrv1+Ib1) becomes a light emission amount obtained by superimposing the PWM light emission level P(Idrv1) by the pulse width modulation on the weak light emission level P(Ib1). More specifically, the SH12, SH11, and BASE1 signals are in the above-described setting state, and the engine controller 122 puts the Venb1 signal into an enable state, and causes the switching circuit 106 to perform ON/OF operation using the DATA1 signal based on the VIDEO1 signal. Accordingly, the light emission becomes possible in the light emitting states at two levels between the driving current Ib1 and the Idrv1+Ib1, that is, between the light emission intensity P(Ib1) and the light emission intensity P(Idrv1+Ib1). Further, at a light amount of the light emission level P(Idrv1+Ib1), light emission at a time which follows a pulse duty is performed based on the light emission intensity P(Ib1).

By operating the circuit in FIG. 3 as described above, the engine controller 122 can perform the APC on the LD 107*a* at the weak light emission level, and to emit the light at the weak light emission level P(Ib1). Further, by using the DATA1 signal based on the VIDEO1 signal transmitted from the video controller 123, the engine controller 122 can perform light emission at the print level P(Idrv1+Ib1) which is a first level in the laser light emitting region, and have the light emission levels of two levels.

Figure 9A:
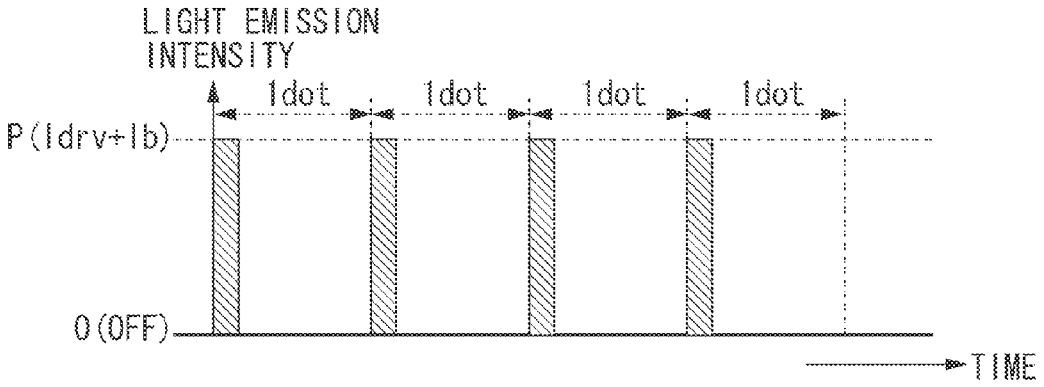
FIGS. 9A and 9B illustrate a relationship between weak light emission and PWM light emission.
Figure 9B:
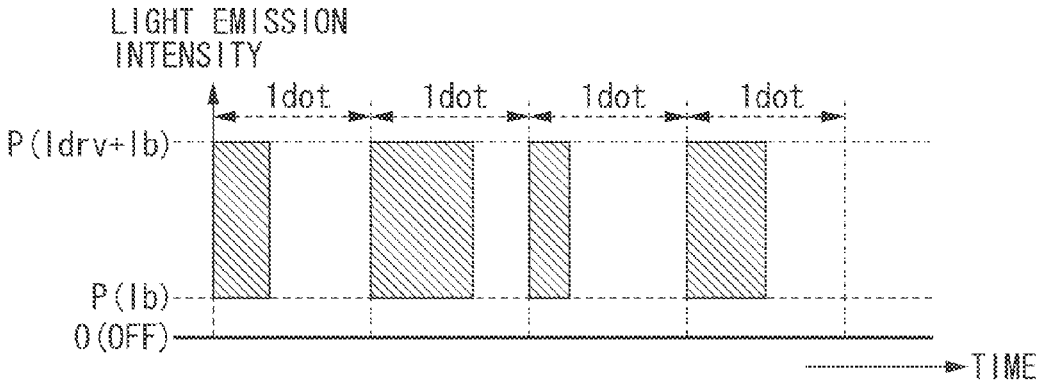

The configuration related to the control of the LD 107*a* is described above. The configuration related to the control of the LD 107*b* is similar thereto, so that the LD 107*b* can perform light emission at two light emission levels, namely a weak light emission level P(Ib2) which does not cause toner to adhere and a print level P(Idrv2+Ib2) which is enough to cause the toner to adhere. Now, a difference from the conventional light emission method will be described. FIGS. 9A and 9B each illustrate light emission intensity of each pixel. FIG. 9A illustrates a case where weak light emission is performed by the conventional PWM method. FIG. 9B illustrates a case where weak light emission is performed by the method according to the present exemplary embodiment.

As illustrated in FIG. 9A, according to the conventional PWM method, since light emission can be performed at a light emission level of only one level equivalent to the print level P(Idrv+Ib). Therefore, in the weak light emission, light emission (oblique line portions in FIGS. 9A and 9B) at the print level is performed at a predetermined ratio (a minute pulse width corresponding to a weak light emission amount) for each one pixel in the non-image portion, in synchronization with an image clock which has fixed frequency, so that a light amount equivalent to the weak light emission level is realized.

In contrast, according to the present exemplary embodiment, as illustrated in FIG. 9B, light emission can be performed at two light emission levels, that is the weak light emission level P(Ib) and the print level P(Idrv+Ib), and a light emission amount at the weak light emission level is obtained by continuing light emission at weak light emission level P(Ib). In other words, the light emission amount can be obtained by superimposing the PWM light emission (the oblique line portion in FIG. 9B) at the light emission level P(Idrv) which has been subjected to pulse width modulation according to the image data (VIDEO data) on the weak light emission level P(Ib). Consequently, produced radiation noises can be kept lower than those of the conventional PWM method.

<Another Laser Driving System Circuit Diagram>

Figure 6:
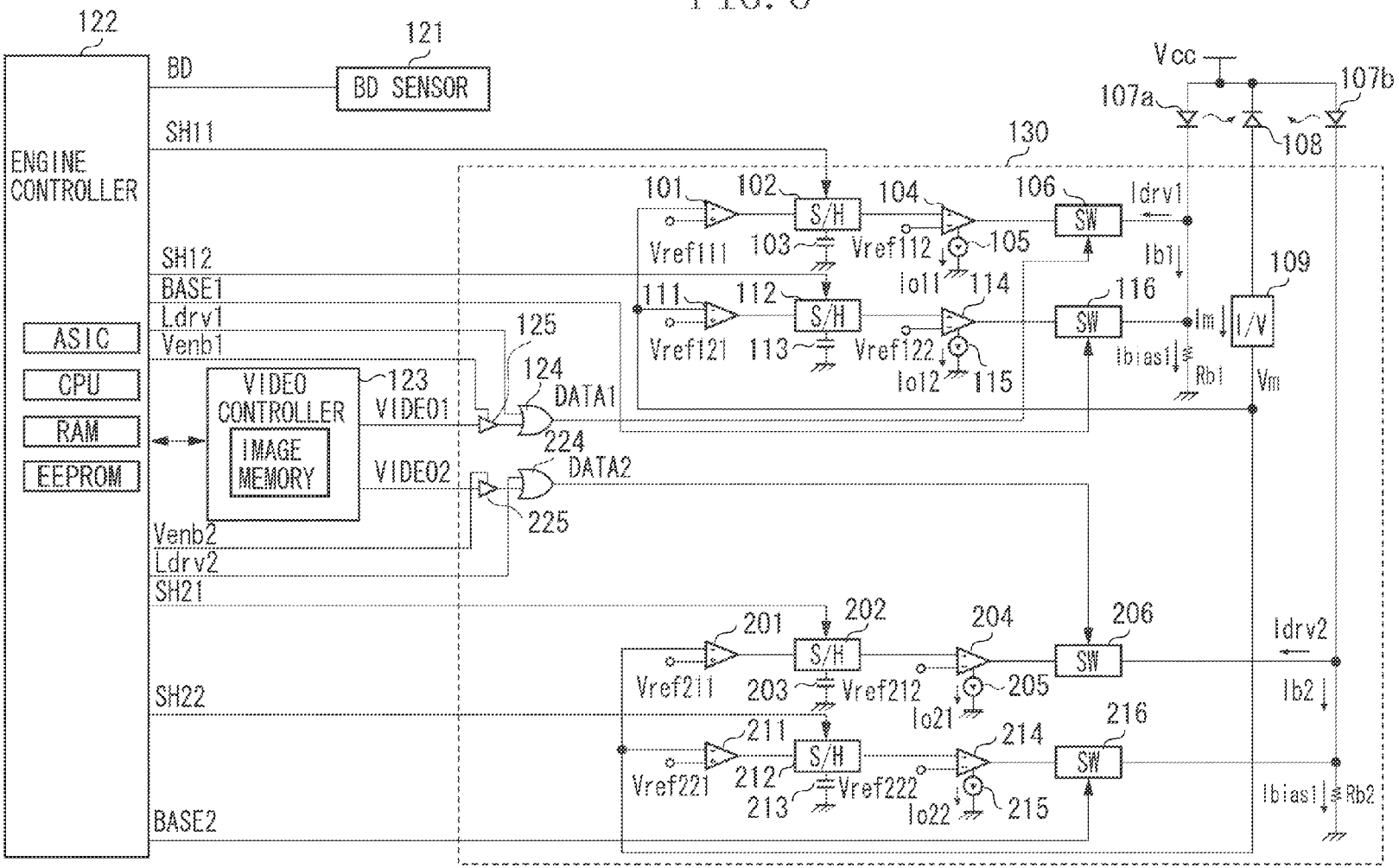
FIG. 6 is another circuit diagram of a laser driving circuit.
Figure 7:
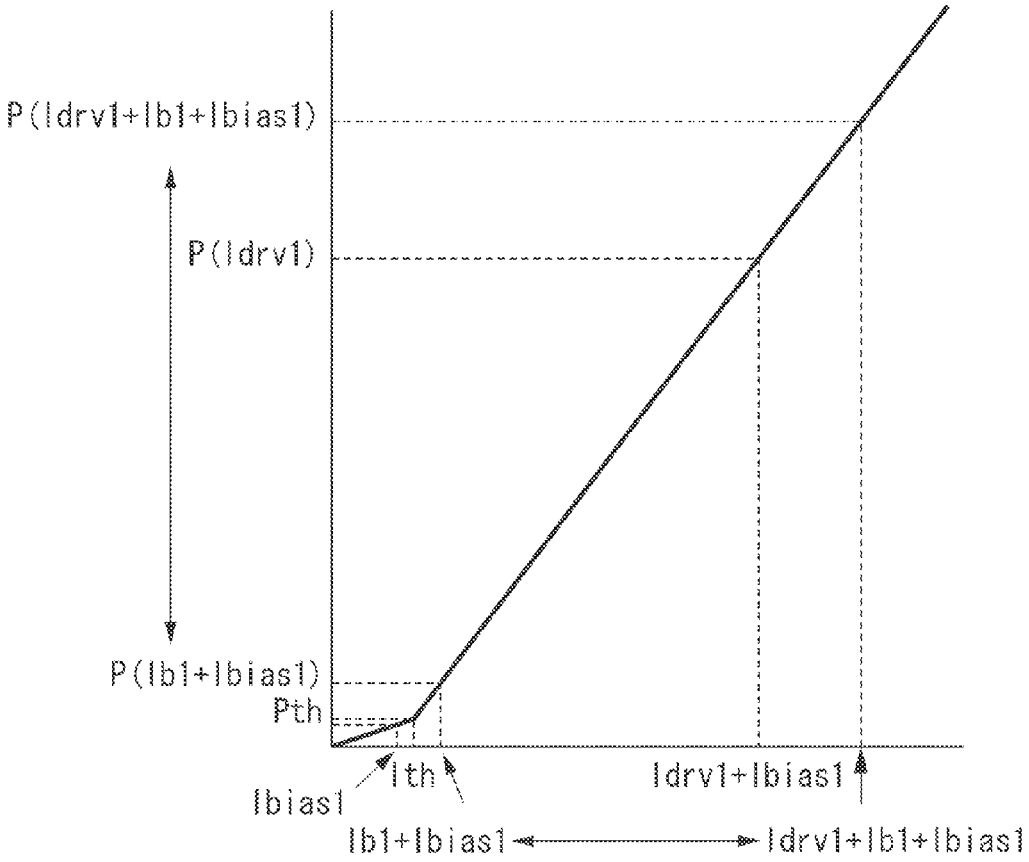
FIG. 7 illustrates a relationship between electric current flowing through a laser diode and light emission intensity.

A circuit illustrated in FIG. 6 is different from the circuit illustrated in FIG. 3 in the respect that resistances Rb1 and Rb2 are added to which bias currents Ibias1 and Ibias2 are applied respectively. The bias current Ibias1 is set smaller than a threshold value current Ith of the LD 107*a*, and is set in a range out of the laser light emitting region (usually referred to as an LED light emitting region). The relationship between laser light emission intensity and electric current value is illustrated in FIG. 7. The effects of the bias currents may include improvement in a rising characteristic of the LD 107*a* and the like, as discussed in various literatures In the circuit in FIG. 6, the sample and hold circuit 112 is put into the hold state by the SH12 signal, and the switching circuit 116 is put into an ON operation, so that the driving current (Ib1+Ibias1) is supplied to the LD 107*a*. In the circuit in FIG. 6, at that time, the LD 107*a* performs light emission with the weak light emission level light emission intensity P(Ib1+Ibias1). At that time, the light emission level P(Ib1+Ibias1) is in the laser light emitting region. Further, the sample and hold circuit 102 is set to the hold period by the SH11 signal, and the switching circuit 106 is put into an ON operation by the input signal DATA1, so that the driving current Idrv1 is further supplied. Accordingly, the driving current (Idrv1+Ib1+Ibias1) in all is supplied, and light emission at the light emission level P(Idrv1+Ib1+Ibias1) for normal printing is performed.

As described above, the LD 107*a* switches the light emission with the light emission intensity of the print level P(Idrv1+Ib1+Ibias1) and the light emission at the weak light emission level light emission intensity P(Ib1+Ibias1) of the driving current (Ib1+Ibias1) by the ON/OFF operation of the switching circuit 106. More specifically, when the SH12, SH11, BASE1 signals are in the above-described setting states, the engine controller 122 puts the Venb1 signal into the enable state, and causes the switching circuit 106 to perform the ON/OFF operation by the DATA1 signal based on the VIDEO1 signal. Accordingly, the PWM laser light emission can be performed in the light emitting states at two levels which fall between the driving current (Ib1+Ibias1) and the driving current (Idrv1+Ib1+Ibias1), that is, between the light emission intensity P(Ib1+Ibias1) and P(Idrv1+Ib1+Ibias1).

A control method for the LD 107*a*, of two laser diodes in two-beam laser diodes LD 107 has been described above. With regard to a control method for the LD 107*b*, since it is controlled similarly to the LD 107*a*, detailed descriptions thereof will not be repeated.

<APC Sequences at Two Levels>

Next, a timing of the APC to maintain a light emission level of laser will be described. The optical scanning device 9 according to the present exemplary embodiment has a configuration of including a plurality of light emitting units of the LD 107*a* and the LD 107*b*. Therefore, it is desirable that each of the LD 107*a* and the LD 107*b* can adjust the light emission level for normal printing and the light emission level for weak light emission. Thus, an adjustment method for appropriately adjusting respective light emission levels in the configuration including such a plurality of light emitting units will be described.

Figure 8:
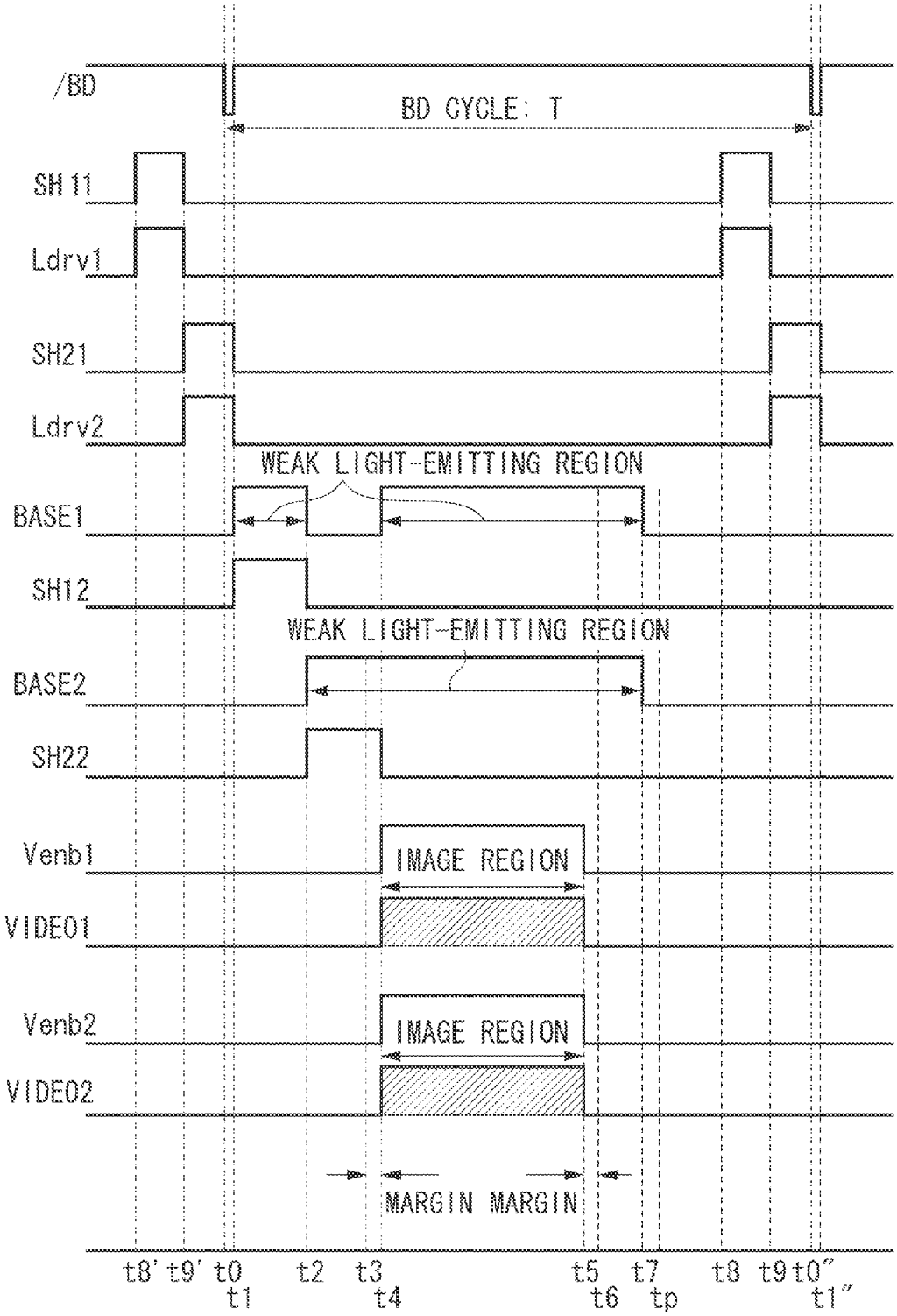
FIG. 8 is a timing chart related to automatic light amount control.

FIG. 8 is a timing chart related to laser scanning. The timing chart is repeated each horizontal synchronization signal cycle (BD cycle) T, and is performed a plurality of times in one print job.

First, the engine controller 122 performs APC (APC_Pa) at strong light emission level with respect to the LD 107*a*. At a timing t8', the engine controller 122 turns the SH11 signal and the Ldrv1 signal ON, and turns the switching circuit 106 ON. Then, at a timing t9', the engine controller 122 turns the SH11 signal and the Ldrv1 signal OFF, and turns the switching circuit 106 OFF. Accordingly, the engine controller 122 ends the APC at the strong light emission level with respect to the LD 107*a*.

Next, the engine controller 122 performs APC (APC_Pb) at the strong light emission level with respect to the LD 107*b*. At a timing t9', the engine controller 122 turns the SH21 signal and Ldrv2 signal ON, and turns the switching circuit 206 ON. After a horizontal synchronization signal/BD is detected by the engine controller 122 at a timing t0, at a timing t1, the engine controller 122 turns the SH21 signal the Ldrv2 signal OFF, and turns the switching circuit 206 OFF. Accordingly, the engine controller 122 ends the APC at the strong light emission level with respect to the LD 107*b*.

Next, the engine controller 122 performs APC (APC_Ba) at the weak light emission level with respect to the LD 107*a*. At a timing t1, the engine controller 122 turns the SH12 signal and the BASE1 signal ON, and turns the switching circuit 116 ON. Accordingly, the engine controller 122 starts the APC at the weak light emission level. Then, at a timing t2, the engine controller 122 turns the SH12 signal and the BASE1 signal OFF, and ends the APC at the weak light emission level.

Next, the engine controller 122 performs APC (APC_Bb) at the weak light emission level with respect to the LD 107*b*. At a timing t2, the engine controller 122 turns the SH22 signal and the BASE2 signal ON, and turns the switching circuit 2160N. Accordingly, the engine controller 122 starts the APC at the weak light emission level. Then, the engine controller 122 maintains the SH22 signal in the ON state to a timing t4. In other words, the engine controller 122 continues the APC at the weak light emission level until the timing t4. Accordingly, the engine controller 122 can secure the APC time longer at the weak light emission level.

A timing when scanned laser beams reach a position corresponding to an edge of paper (recording material) on the photosensitive drum 5 is a timing t3, and a relationship of t1<t3<t4 is satisfied. In other words, the timing from t3 to t4 is a margin region period during which the laser beams are emitted on the margin region of the paper. Further, in a case of what is referred to as a marginless printing, since an image formable region (effective region of the photosensitive drum) exceeds the paper edge portion, there is no margin region on the paper, and a relationship of t1<t4<t3 is satisfied.

As described above, the automatic light amount adjustment of the laser beams is performed in the non-image region (out of the effective region of the photosensitive drum) such as between the scanning lines in one horizontal synchronization signal cycle (D cycle). However, as downsizing of the image forming apparatus or the optical scanning device is promoted, a ratio of the image formable region (the effective region of the photosensitive drum 5) in one scanning (or during one BD cycle) in the optical scanning device is increased, and time ratio of the non-image region will be decreased. In such a case, according to the timing chart in FIG. 8, the automatic light amount adjustment which is executed when the SH12 signal and the SH22 signal are valid will be executed after the horizontal synchronization signal/BD is output, so that the automatic light amount adjustment can be continued even at a timing when the laser scanning comes into the margin portion of the paper.

Next, light emission for image formation (hereinbelow, referred to as VIDEO light emission) of the LD 107*a* and the LD 107*b* is started. From a timing t4 after a predetermined time has elapsed on the basis of an output timing (t0 or t1) of the horizontal synchronization signal/BD, the engine controller 122 inputs enable signal instructions to enable terminals of the buffer 125 and the buffer 225 using the Venb1 signal and the Venb2 signal, respectively. Further, according to the enable signal instruction to the enable terminal, the video controller 123 outputs the VIDEO1 signal and the VIDEO2 signal from the timing t4 after the predetermined time has elapsed on the basis of the output timing (t0 or t1) of the horizontal synchronization signal/BD. Then, the LD 107 emits light at the light emission level P(Ib+Idrv) for printing, and laser scanning is performed by the optical scanning device illustrated in FIG. 2. Then, the optical scanning device scans the image region of the photosensitive drum with dots of the laser beams in response to the VIDEO signal.

In the main scanning direction, the weak light emitting region where light is emitted with the light emission amount at the weak light emission level, has a region larger than a maximum image region scanned by the VIDEO1 signal and the VIDEO2 signal, and weak light emission is performed in a region larger than a region corresponding to a period from a paper edge timing t3 to a paper edge timing t6. Further, weak light emission is performed in the non-image portion in the regions of the VIDEO1 signal and the VIDEO2 signal.

Next, light emission for image formation (hereinbelow, referred to as VIDEO light emission) of the LD 107*a* and the LD 107*b* is terminated. The engine controller 122 inputs disable signal instructions to enable terminals of the buffer 125 and the buffer 225 using the Venb1 signal and Venb2 signal respectively, at a timing t5 after a predetermined time has elapsed on the basis of the output timing (t0 or t1) of the horizontal synchronization signal/BD. Accordingly, light emission for image formation is terminated.

Next, the weak light emission of the LD 107*a* and the LD 107*b* is terminated. The engine controller 122 turns the switching circuit 116 and the switching circuit 216 OFF using the BASE1 signal and the BASE2 signal, at a timing t7 after a predetermined time has elapsed on the basis of the output timing (t0 or t1) of the horizontal synchronization signal/BD, and ends the weak light emission. At that time, a paper edge timing t6 when the scanned laser beams pass through a position corresponding to the edge of paper (recording material) on the photosensitive drum 5 may satisfy a relationship of t5<t6<t7.

In a case of the marginless printing, a relationship of t6<t5<t7 is obtained. An end timing t7 of the weak light emission ends earlier than a polygon edge timing tP in FIG. 8, however the timing t7 may be set longer to a timing t8.

As described above, the automatic light amount adjustment at the weak light emission level can be performed between (the timing t1 and the timing t7) which is a region wider than an image region (between the timing t4 and the timing t5), and wider than between paper edges (between the timing t3 and the timing t6).

Further, the engine controller 122 repetitively executes the processing which is described to be performed at the timing t8' and later, from the timing t8 after a predetermined time has elapsed on the basis of the output timing (t0 or t1) of the horizontal synchronization signal/BD. Accordingly, when a print job is executed in response to a print request from the outside, a plurality of times of various types of APC can be efficiently performed.

As described above, according to the present exemplary embodiment, the following effects can be obtained. As described above, the light emission at the weak light emission (non-image portion weak light emission) level is at a level not to cause developer such as toner to be charged and attached to the photosensitive drum by the laser irradiation. Consequently, a light emission intensity setting at the weak light emission (non-image portion weak light emission) level can be performed at the timing of the non-image region (before image region) including an effective image region of the photosensitive drum. Accordingly, if the non-image region out of the effective image region of the photosensitive drum is reduced by downsizing of the main body and downsizing of the optical scanning device, APC time at two levels can be secured longer.

Then, the timing chart in FIG. 8 is executed a plurality of times in one job (one print job). Therefore, in each of two light emitting units, a light amount of the light emission to the image portion, and a light amount of the weak light emission can be adjusted a plurality of times in one job, so that the charging potential Vd can be appropriately maintained through one job, and as a result, reverse fogs or positive fogs can be suppressed. Accordingly, images with more higher image quality can be obtained.

In the timing chart in FIG. 8, the light emission levels P(Ib) and P(Idrv+Ib) are described. However, similar processing can be achieved in the circuit illustrated in FIG. 6 by replacing the light emission levels P(Ib) and P(Idrv+Ib) with the light emission levels P(Ib+Ibias) and P(Idrv+Ib+Ibias), respectively.

According to a second exemplary embodiment, implementation for further developing the first exemplary embodiment, and assigning more time to two levels of the APC will be described. Since the configuration of the image forming apparatus and the configuration of the circuits are basically similar to those in the first exemplary embodiment, descriptions thereof will not be repeated. Further, a timing chart of the APC according to the second exemplary embodiment will be described below with reference to FIG. 10, however since the processing up to the timing t7 is similar to that in the first exemplary embodiment, descriptions thereof will not be repeated. Hereinbelow, descriptions will be provided focusing on differences.

Figure 10:
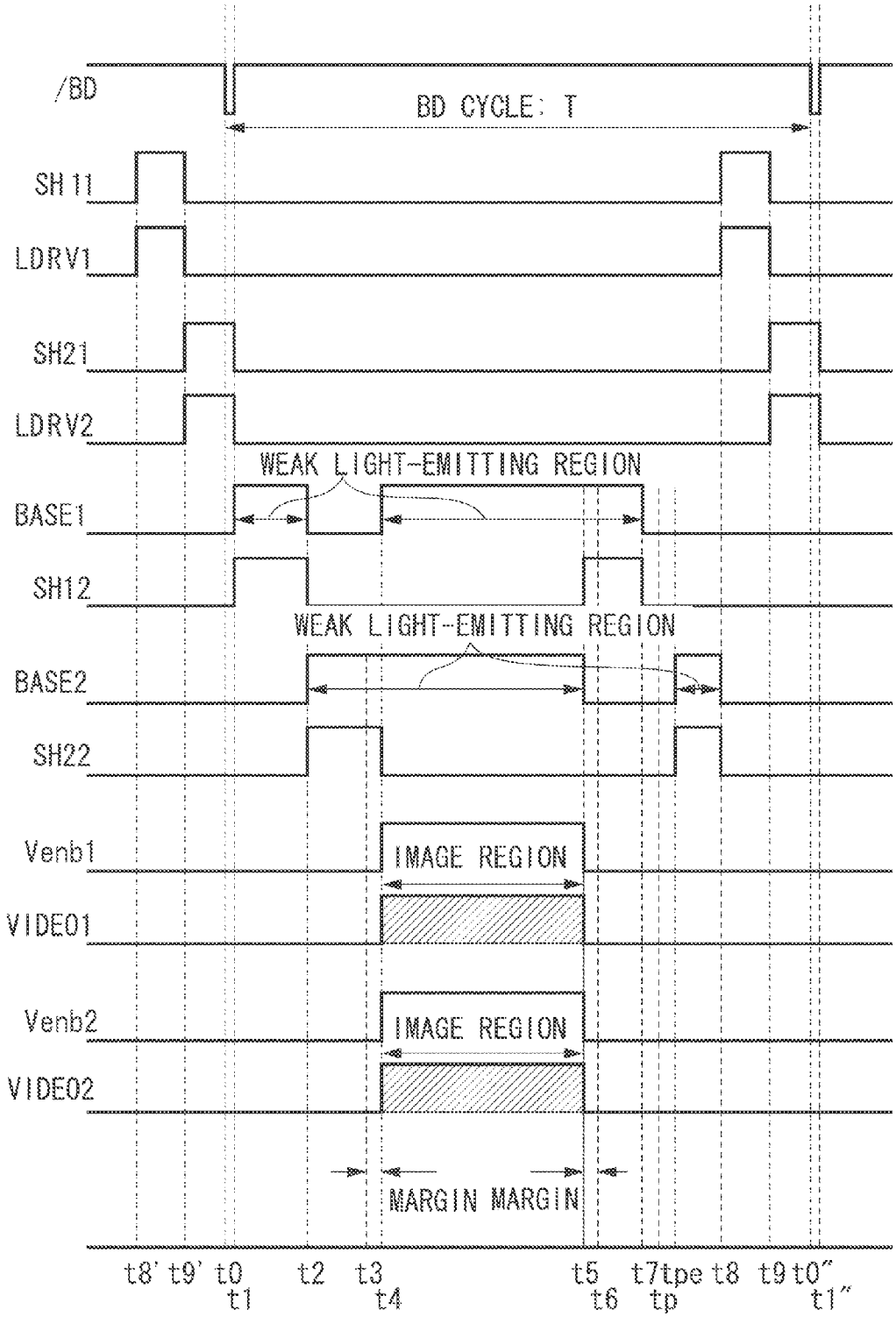
FIG. 10 is another timing chart related to automatic light amount control.
Figure 11:
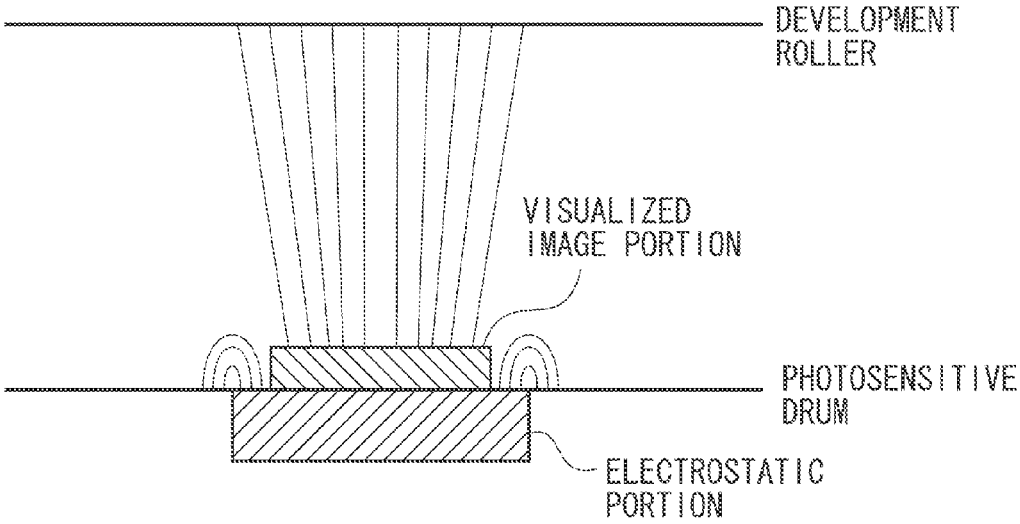
FIG. 11 illustrates why a white gap is generated.

FIG. 10 is a timing chart illustrating timings of light scanning according to the second exemplary embodiment. The major features of the present exemplary embodiment is that a light emission intensity setting at the weak light emission (non-image portion weak light emission) level can be also performed at a timing of the non-image region (after image region) including the effective image region of the photosensitive drum.

More specifically, the video controller 123 scans the image region of the photosensitive drum with dots of the laser beams in response to the VIDEO signal, until the timing t5 after a predetermined time has elapsed on the basis of the output timing (t0 or t1) of the horizontal synchronization signal/BD, and ends the image scanning.

At the same timing, the engine controller 122 inputs a disable signal instruction to the enable terminals of the buffer 125 and the buffer 225 using the Venb1 signal and Venb2 signal respectively from the timing t5 after the predetermined time has elapsed on the basis of the output timing (t0 or t1) of the horizontal synchronization signal/BD.

The engine controller 122 starts the APC_Ba at the weak light emission level by turning the SH12 signal ON at the timing t5 after the predetermined time has elapsed on the basis of the output timing (t0 or t1) of the horizontal synchronization signal/BD.

Then, the engine controller 122 maintains the SH12 signal in the ON state and continues the APC_Ba at the weak light emission level up to the timing t7. When the timing t7 comes, the engine controller 122 turns the SH12 signal OFF, turns the switching circuit 116 OFF by the BASE1 signal, and ends the APC_Ba of the weak light emission. It is assumed that there is a change timing tP of the polygon mirror surface during a forcible light emission period of the automatic light amount adjustment. Therefore, from the timing t7 to the timing tPe, the engine controller 122 stops the light emission of the laser beams in order to avoid stray light in the reflection on edge portions (portions in the vicinity of boundaries of reflection surfaces) of the polygon mirror 133 (however, the timing tPe is a time when reflection on polygon edge portions ends).

Further, the engine controller 122 starts the APC_Bb at the weak light emission level by turning the BASE2 signal and the SH22 signal ON at the timing tPe after a predetermined time has elapsed on the basis of the output timing (t0 or t1) of the horizontal synchronization signal/BD. Then, the engine controller 122 maintains the BASE2 signal and the SH22 signal in the ON state and continues the APC_Bb at the weak light emission level until the timing t8 comes. When the timing t8 comes, the engine controller 122 turns the SH22 signal OFF, turns the switching circuit 216 OFF by the BASE2 signal, and ends the APC_Bb of the weak light emission.

Further, the engine controller 122 turns the SH11 signal ON from the timing t8 after the predetermined time has elapsed on the basis of the output timing (t0 or t1) of horizontal synchronization signal/BD, and turns the switching circuit 106 ON by the Ldrv1 signal to start the APC_Pa at the strong light emission level. Then, the engine controller 122 continues the APC_Pa until the timing t9.

The engine controller 122 turns the SH21 signal ON from the timing t9 after a predetermined time has elapsed on the basis of the output timing (t0 or t1) of the horizontal synchronization signal/BD, and turns the switching circuit 206 ON by the Ldrv2 signal to start the APC_Pb at the strong light emission level. Then, the engine controller 122 continues the APC_Pa until a timing t1".

Then, an output of the sensor 121 for synchronization detection is output at a timing t0" as the horizontal synchronization signal/BD. The engine controller 122, when detecting the horizontal synchronization signal/BD at the timing t0", repetitively executes the sequence at the timing t0 and later described above.

As described above, according to the second exemplary embodiment, the following effects are obtained in addition to the effects similar to those in the first exemplary embodiment. More specifically, a time period from a margin portion t5 of paper which is a timing of the non-image region (after image region) including the effective image region of the photosensitive drum to a light emission intensity setting start timing t8 at the strong light emission level can be regarded as a light emission intensity setting timing at the weak light emission level. Accordingly, time for the automatic light amount adjustment of the weak light emission can be secured much longer.

In the timing chart in FIG. 10, the light emission levels P(Ib) and P(Idrv+Ib) are described. However, similar processing can be achieved in the circuit illustrated in FIG. 6 by replacing the light emission levels P(Ib) and P(Idrv+Ib) with the light emission levels P(Ib+Ibias) and P(Idrv+Ib+Ibias), respectively.

According to the first and second exemplary embodiments, examples of repeating various types of APC sequences with respect to each BD cycle (each time one main-scanning is performed) are described. In other words, in various types of APC sequences described in the first and second exemplary embodiments are sequences for executing the following four types of APC at least one time each in one BD cycle. Respective contents can be summarized as follows.

APC_Ba: APC for weak light emission of the LD 107*a*
APC_Bb: APC for weak light emission of the LD 107*b*
APC_Pa: APC for strong light emission of the LD 107*a*
APC_Pb: APC for strong light emission of the LD 107*b*

By the way, when one BD cycle becomes shorter accompanying with downsizing of the image forming apparatus or the optical scanning device and increase of rotational speed of the polygon mirror 133, it may become difficult in some cases to secure the APC time. In other words, all the above-described four types of APC may not be executed in one BD cycle.

According to a third exemplary embodiment, as for the APC for weak light emission (the APC_Ba and the APC_Bb), either one the APC for weak light emission is alternately executed for each BD cycle, instead of executing all the above-described four types of APC in one BD cycle.

More specifically, in odd-numbered times of the D cycle in one job, the engine controller 122 performs a first adjustment step for executing the APC_Ba, the APC_Pa, and the APC_Pb without executing the APC_Bb of the LD 107*b* in one BD cycle. Whereas, in an even-numbered times of the BD cycle in one job, the engine controller 122 performs a second adjustment step for executing the APC_Bb, the APC_Pa, and the APC_Pb without executing the APC_Ba of the LD 107*a* in one BD cycle.

In this way, either one of the APC_Ba and the APC_Bb which are the APC for weak light emission is alternately thinned out (unexecuted) in each BD cycle. In other words, the first adjustment step and the second adjustment step are alternately executed in each BD cycle. These processes are summarized in Table 1.

As described above, the APC time can be secured by alternately thinning out the APC for weak light emission of the LD 107*a* and the LD 107*b* in each BD cycle.

According to the present exemplary embodiment, since influence of light amount decrease due to droop is significant in the strong light emission with a large laser light amount, the APC_Pa and the APC_Pb are executed in each of the entire BD cycles. However, in a case where the influence of light amount decreases due to the droop is permissible, the APC for strong light emission may be thinned out.

TABLE 1

| BD Cycle | APC_Ba | APC_Bb | APC_Pa | APC_Pb |
|---|---|---|---|---|
| Odd-numbered time around | Executed | Unexecuted | Executed | Executed |
| Even-numbered time around | Unexecuted | Executed | Executed | Executed |

According to the first and second exemplary embodiments, the configuration for performing each of the APC at the light emission level P(Idrv) and the APC at the light emission level P(Ib) in each of the LD 107*a* and the LD 107*b* is described. However, an adjustment method of the driving current Idrv and the driving current Ib for emitting light at two light emission levels is not limited to the above method. According to a fourth exemplary embodiment, another APC method will be described.

<Another APC Method (1)>

Next, another APC method (1) will be described with reference to FIG. 3. In another APC method (1), the APC at the light emission level P(Ib) and the APC at the light emission level P(Ib+Idrv) are performed.

More specifically, first, APC (APC_Ba) of the light emission level P(Ib1) is executed. Next, APC of the light emission level P(Ib+Idrv) is performed. First, the engine controller 122 puts the sample and hold circuit 112 into a hold period by the SH12 signal, and further turns the switching circuit 116 to an ON state by the input signal BASE1. In other words, the LD 107*a* is put into a state in which the driving current Ib1 is supplied thereto. At the same time, the engine controller 122 sets the sample and hold circuit 102 to a sampling state, puts the switching circuit 106 into the ON state by the input signal DATA1 similarly to the above-described exemplary embodiments, supplies the driving current Idrv in addition to the driving current Ib1 to the LD 107*a*, and causes the LD 107*a* to emit light.

In this state, the engine controller 122 monitors a light emission amount of the LD 107*a* by the PD 108. Further, the engine controller 122 generates a monitor current Im1' proportional to an actual light emission amount, and applies the monitor current Im1' to the current voltage conversion circuit 109 to generate a monitor voltage Vm1'.

The current amplification circuit 104 adjusts the driving current Idrv to become the driving current Idrv1' based on the current Io11' flowing through the reference current source 105 so that the monitor voltage Vm1' coincides with the first reference voltage Vref111' as a target value. The reference voltage Vref111' has a voltage value corresponding to the light emission level P(Ib1+Idrv1). Further, the driving current Idrv1' becomes a difference between an electric current for emitting light with a light amount of the light emission level P(Ib1+Idrv1) and an electric current for emitting light with a light amount of the light emission level P(Ib1). The APC operation at the strong light emission level is referred to as APC_Pa'.

As for the LD 107*b*, the engine controller 122 performs the APC by the control similar to described above to control the driving current Idrv2'. The APC operation at the strong light emission level in the LD 107*b* is referred to as APC_Pb'.

In a case of the above-described APC method, the APC of the light emission level P(Ib1) needs to be executed at a timing before the APC of the light emission level P(Ib1+Idrv1) is performed. Therefore, in a case of the sequence according to the first exemplary embodiment, in FIG. 8, the sequence is only necessary to be changed to perform the APC_Ba from the timing t8' to the timing t9' and from the timing t8 to the timing t9, to perform the APC_Pa' from the timing t9' to the timing t1 and from the timing t9 to the timing t1", to perform the APC_Bb from the timing t1 to the timing t2, and to perform the APC_Pb' from the timing t2 to the timing t3. Further, in FIG. 8, the sequence may be changed to perform the APC_Ba from the timing t8' to the timing t9' and from the timing t8 to the timing t9, to perform the APC_Bb from the timing t9' to the timing t0 and from the timing t9 to the timing t0", to perform the APC_Pa' from the timing t0 to the timing t2, and to perform the APC_Pb' from the timing t2 to the timing t3.

Further, in a case of the sequence according to the second exemplary embodiment, in FIG. 10, the sequence is only necessary to be changed to perform the APC_Pa' from the timing t8' to the timing t9' and from the timing t8 to the timing t9, and to perform the APC_Pb' from the timing t9' to the timing t1 and from the timing t9 to the timing t1".

In the above descriptions, the light emission levels P(Ib) and P(Idrv+Ib) are described. However, similar processing can be achieved in the circuit illustrated in FIG. 6 by replacing the light emission levels P(Ib) and P(Idrv+Ib) with the light emission levels P(Ib+Ibias) and P(Idrv+Ib+Ibias), respectively.

<Another APC Method (2)>

Next, another APC method (2) will be described with reference to FIG. 3. In another APC method (2), the APC at the light emission level P(Idrv) and the APC at the light emission level P(Ib+Idrv) are performed.

More specifically, after executing the APC (APC_Pa) of the light emission level P(Idrv1), the engine controller 122 puts the sample and hold circuit 102 into the hold period (non-sampling period) by the SH11 signal according to an instruction of the engine controller 122, puts the switching circuit 106 into an ON state, and supplies the driving current Idrv1 to the LD 107*a*. At the same time, the engine controller 122 puts the sample and hold circuit 112 into the APC operation by the SH12 signal, puts the switching circuit 116 into the ON state by the input signal BASE1, and supplies the driving current Ib in addition to the driving current Idrv1 to the LD 107*a* to cause the LD 107*a* to emit light.

In this state, the engine controller 122 monitors a light emission amount of the LD 107*a* by the PD 108. Then, the engine controller 122 generates a monitor current Im2' (Im1<Im2') proportional to an actual light emission amount, and applies the monitor current Im2' to the current voltage conversion circuit 109 to generate a monitor voltage Vm2'.

The current amplification circuit 114 adjusts the driving current Ib to become the driving current Ib1' based on the current Io12' flowing through the reference current source 115 so that the monitor voltage Vm2' coincides with a voltage Vref121' which is set to a potential to be the second reference voltage as a target value. Then, when the engine controller 122 turns the SH12 signal OFF and puts the sample and hold circuit 112 into the hold state, a voltage corresponding to the driving current Ib1' is charged to the capacitor 113. The reference voltage Vref121' has a voltage value corresponding to the light emission level P(Ib1+Idrv1). The driving current Ib1' becomes a difference between an electric current for emitting light with a light amount of the light emission level P(Ib1+Idrv1) and an electric current for emitting light with a light amount of the light emission level P(Ibrv1). The APC operation at the weak light emission level is referred to as APC_Ba'.

As for the LD 107*b*, the engine controller 122 performs the APC by the control similar to the above-described one to control the driving current Ib2'. The APC operation at the strong light emission level in the LD 107*b* is referred to as APC_Bb'.

In a case of the above-described APC method, the sequence according to the first exemplary embodiment is only necessary to be changed, in FIG. 8, to perform the APC_Ba' from the timing t1 to the timing t2, and to perform the APC_Bb' from the timing t2 to the timing t3. Further, in FIG. 8, the sequence may be changed to perform the APC_Ba' from the timing t9' to the timing t0 and from the timing t9 to the timing t0", to perform the APC_Pa from the timing t0 to the timing t2, and to perform the APC_Bb' from the timing t2 to the timing t3 or t4.

Further, in a case of the sequence according to the second exemplary embodiment, in FIG. 10, the sequence is only necessary to be changed to perform the APC_Ba' from the timing t1 to the timing t2 and from the timing t6 to the timing t7, and to perform the APC_Bb' from the timing t2 to the timing t3 or t4 and from the timing tPe to the timing t8.

As described above, by applying the other APC methods described in the present exemplary embodiment to the timing charts in FIG. 8 and FIG. 10, the timing charts are executed a plurality of times in one job (one print job). According to this processes, similarly to the first exemplary embodiment, a light amount of light emission to an image portion and a light amount of the weak light emission can be adjusted a plurality of times in one job in each of the two light emitting units, and the charging potential Vd can be appropriately maintained throughout one job, and as a result, reverse fogs or positive fogs can be inhibited. Accordingly, images with more higher image quality can be obtained.

In the above descriptions, the light emission levels P(Ib) and P(Idrv+Ib) are described. However, similar processing can be achieved in the circuit illustrated in FIG. 6 by replacing the light emission levels P(Ib) and P(Idrv+Ib) with the light emission levels P(Ib+Ibias) and P(Idrv+Ib+Ibias), respectively.

As described above, according to the present invention, light emission to an image portion with a stable light amount and weak light emission to a non-image portion can be performed, and accordingly, images with more higher image quality can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims the benefit of Japanese Patent Application No. 2012-131292 filed Jun. 8, 2012, which is hereby incorporated by reference herein in its entirety.

What is claimed is:

1. An image forming apparatus comprising:

a photosensitive member;

a charging unit configured to charge the photosensitive member;

a first light emitting unit and a second light emitting unit each configured to independently perform light emission of a laser beam, wherein a latent image is formed on the charged photosensitive member by light emission of the first and the second light emitting units, and an image is formed on a recording material by attaching toner to the latent image to visualize it;

a driving unit configured to cause the first and the second light emitting units to emit light by a driving current, wherein the driving unit causes each of the first and the second light emitting units to emit light in a time following a pulse duty with a light amount at a first light emission level for printing on an image portion in an image formable region of the photosensitive member according to input of print data, and causes each of the first and the second light emitting units to emit light with a light amount at a second light emission level of weak light emission on a non-image portion in the image formable region of the photosensitive member, and wherein the driving unit causes the first light emitting unit to emit light at the first light emission level by a driving current obtained by adding a first driving current to a second driving current, causes the first light emitting unit to emit light at the second light emission level by the second driving current, causes the second light emitting unit to emit light at the first light emission level by a driving current obtained by adding a third driving current to a fourth driving current, and causes the second light emitting unit to emit light at the second light emission level by the fourth driving current; and an adjustment unit configured to adjust each of the first, the second, the third, and the fourth driving currents a plurality of times in one job, wherein the adjustment unit is configured to execute a first adjustment step for adjusting the first, the second, and the third driving currents without adjusting the fourth driving current in one horizontal synchronization signal cycle, and a second adjustment step for adjusting the first, the third, and the fourth driving currents without adjusting the second driving current in the one horizontal synchronization signal cycle, and alternately executes the first adjustment step and the second adjustment step in each horizontal synchronization signal cycle.

2. The image forming apparatus according to claim 1, wherein the adjustment unit, after adjusting the second driving current while the first light emitting unit is emitting light by the second driving current, adjusts the first driving current while the first light emitting unit is emitting light by a driving current obtained by adding the first driving current to the adjusted second driving current.

3. The image forming apparatus according to claim 1, wherein the adjustment unit includes a light receiving portion configured to receiving laser beams emitted from the first and the second light emitting units, and adjusts each of the first, the second, the third, and the fourth driving currents based on an output from the light receiving portion according to a light receiving amount.

4. The image forming apparatus according to claim 1, wherein a light amount at the second light emission level is an amount which varies according to a change in a charging voltage applied by the charging unit.

5. The image forming apparatus according to claim 1, wherein a light amount at the second light emission level is an amount which varies according to a change in charging potential of the charged photosensitive member.

6. The image forming apparatus according to claim 1, wherein the image forming apparatus includes a plurality of the photosensitive members, a plurality of first and second light emitting units respectively corresponding to the photosensitive members, a plurality of driving units respectively corresponding to the photosensitive members, and a plurality of charging units respectively corresponding to the photosensitive members, and forms an image with a plurality of colors on a recording material by forming a toner image of a plurality of colors.

7. The image forming apparatus according to claim 1, wherein the second light emission level is a light emission level for each of the first and second light emitting units to emit laser beams.

* * * * *